United States Patent [19]

Koros

[11] 4,345,940

[45] Aug. 24, 1982

[54] DESULFURIZING PROCESS

[75] Inventor: Peter J. Koros, Pittsburgh, Pa.

[73] Assignee: Jones & Laughlin Steel Incorporated, Pittsburgh, Pa.

[21] Appl. No.: 253,472

[22] Filed: Apr. 13, 1981

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS 4,139,369 2/1979 Kandler ..... 75/58

4,142,887 3/1979 Luyckx ..... 75/58

4,266,969 5/1981 Koros ..... 75/53

*Primary Examiner*—P. D. Rosenberg

*Attorney, Agent, or Firm*—John Stelmah

[57] ABSTRACT

A process for desulfurizing a bath of molten iron contained in a vessel comprising the injection of particulate lime and a particulate hydrocarbon containing carbon and hydrogen in properties ranging from $CH_{>0}$ to $CH_2$ and having a volatile matter concentration of 5 to 20%, by weight, or a premixture of the lime and hydrocarbon, which premixture has a loss on ignition factor of at least 11%, by weight.

10 Claims, No Drawings

DESULFURIZING PROCESS

FIELD OF THE INVENTION

This invention relates to the desulfurization of molten ferrous metals; more particularly to the controlled injection of lime and hydrocarbon particles for desulfurization of molten iron.

DESCRIPTION OF PRIOR ART

The present invention is an improvement of the invention disclosed and claimed in pending U.S. patent application Ser. No. 114,262 (filed Jan. 22, 1980) and matured as U.S. Pat. No. 4,266,969, on May 12, 1981, which is owned by the assignee of the invention described in this application and which is incorporated by reference herein together with commonly assigned U.S. Pat. No. 3,998,625.

U.S. Pat. No. 3,998,625 discloses a desulfurizing process in which a particulate non-oxidizing material, e.g., lime, and particulate magnesium-containing material are mixed in-line and injected into molten ferrous metal. An advantage of the process is the ability to vary the injection rate of the magnesium-containing material during the injection period.

U.S. patent application Ser. No. 114,262 describes a process for desulfurizing a bath of molten iron contained in a vessel comprising the steps of injecting particulate lime and a carbon-containing particulate with a non-oxidizing carrier gas beneath the surface of the bath to remove sulfur from the iron, while controlling the rate of injection of the carbon containing particles to prevent substantial ejection of the bath from the vessel. The preferred carbon-containing materials are disclosed as graphite and a compound containing at least carbon and hydrogen in proportions ranging from $CH_{>0}$ to $CH_2$ and the preferred carrier gas is a hydrocarbon gas. Polyproplene and hydrocarbon resins are cited as being exemplary of the hydrocarbon compounds.

As indicated in my copending application, Ser. No. 114,262, it has been found that the introduction of solid hydrocarbons mixed with finely divided lime into a molten iron bath tends to produce violent agitation within the bath when the hydrocarbon injection rates are relatively high. The cause of this violent agitation is the dissociation of the hydrocarbon when it contacts the molten bath and the attendant release of hydrogen gas within the bath. Thus, when hydrocarbon in the form of polypropylene is used the preferred injection rate is 2.7–4.8 lbs/min.

It will be appreciated that there are many problems associated with operator attendant controlled processes (as is discussed in copending and commonly assigned U.S. patent application Ser. No. 132,968) in which it is desired to maintain positive and even flow of lime and a desulfurizing agent in a fluidized stream. A particular problem attendant with such processes is that of making timely adjustments in the event of deviations from the desired flow rates. Consequently, any deviation in a relatively narrow range of desired flow rate of injected material will have a more pronounced effect than the same deviation might have on a broader permissible flow rate.

The use of polypropylene as disclosed in my U.S. application Ser. No. 114,262 has proven to be successful. However, it has been found that because the hydrogen content of polypropylene is very high, in the order of 14%, its use as a desulfurizing agent requires constant monitoring and very precise control to maintain the injection rate within the above described preferred and somewhat narrow range. It appears that there are very few operators, even amoung the skilled, who are sufficiently proficient to maintain consistently the 3½ to 4 lb/min. preferred polypropylene injection rate.

Polypropylene is a highly refined by-product speciality of the petro-chemical industry. It has been found that the industry does not have readily available quantities of polypropylene in a form and with a purity level suitable for use in desulfurization of molten iron. The supply is problematic and the cost is relatively high as compared to other sources of hydrocarbons which I have discovered to be suitable in a lime-hydrocarbon desulfurizing process.

As indicated above, the use of lime and graphite together with a non-oxidizing carrier gas is described in my copending application Serial No. 114,262. While graphite offers the advantage of not reacting as violently as polypropylene when introduced into a bath of molten ferrous metal, it is necessary to provide means for mild stirring of the bath. Because graphite provides no gas generation, it was found desirable to use a hydrocarbon gas, such as natural gas, as the carrier for the lime and graphite particles. It has been found there are disadvantages attendant with the use of graphite in addition to the need to add a separate hydrocarbon source, the carrier gas, for stirring. With the use of such a carrier gas there is a release of gas bubbles in the molten bath upwardly in a vertical path away from the discharge end of the injector lance, which bubbles tend to carry with them the particulate treating agents and thereby decrease the dwell time of the agents in the bath and hence decrease the opportunity for the agents to react with the sulfur in the molten bath. The use of such a carrier gas is also problematic during fuel gas curtailments such as those which occur during the winter season.

SUMMARY OF THE INVENTION

The present invention is an improvement of the ferrous metal desulfurization practices as described in my copending U.S. application Ser. No. 114,262 and further optimizes operating efficiencies and material costs. The present invention provides a further improvement in desulfurization practices which utilize a combination of lime and a hydrocarbon source material.

The present invention is intended for use in a process of the type described in U.S. Pat. No. 3,998,625 or in a process as described in copending U.S. application Ser. No. 132,968, or in a combination of such processes.

A feature of the present invention is the discovery and use of hydrocarbon source materials which are less volatile than polypropylene and which do not require a hydrocarbon type carrier gas to provide a stirring effect in the molten iron bath being desulfurized. It has been discovered that hydrocarbon particulates having a gas generating ability as measured by their volatile matter concentration (VM) of at least 5% but which have gas generating abilities less than that of polypropylene are desirable. It has been further discovered that anthracite coal with a natural VM of 8 to 10% and green petroleum coke with a normal VM of about 5 to 7% each fulfill such desideratum.

The present invention provides a process for desulfurizing a bath of molten iron contained in a vessel comprising the steps of: injecting particulate lime and a carbon-containing compound containing at least carbon and hydrogen in proportions ranging from $CH_{>0}$ to $CH_2$ and having a volatile matter concentration (VM) of 5 to 20%, by weight, while controlling the rate of injection of the carbon-containing compound to prevent substantial ejection of the bath from the vessel.

DESCRIPTION OF PREFERRED EMBODIMENTS

The process of the present invention may be practiced with equipment and injection procedures substantially in accordance with those described in U.S. Pat. No. 3,998,625 and patent application Ser. No. 114,262. As in the processes described in patent application Ser. No. 114,262, in the present invention, a solid carbon-containing material is substituted for the magnesium-containing material described in U.S. Pat. No. 3,998,625.

The use of hydrocarbon particulates having a VM concentration of 5 to 20%, by wt., and more particularly 8.5 to 11%, by wt., provides several advantages including low cost carbon source, the evolution of a hydrocarbon gas which is slower and more readily controlled than polypropylene, which evolution produces a reaction between lime and carbon units substantially throughout the bath of molten iron.

U.S. Pat. No. 3,998,625 discloses the use of separate dispensers for two constituents of an injection mixture and U.S. application Ser. No. 132,968 discloses the use of multiple dispensers for two or more constituents of an injection mixture and that the flow rates of the individual constituents may be selectively varied during the injection cycle. It is preferred that the process of the present invention be conducted with such separate dispensers, one for the lime and one for the hydrocarbon, and in a manner whereby the injection rates may be selectively varied during the injection cycle, however, it will be understood that a premixed injection mixture of lime and hydrocarbons from a single dispenser may also be utilized. Such premixing, when achieved by a co-pulverization of lime and hydrocarbon (VM source) provides the possibility of using significantly lower cost carbon sources, such as anthracite coal having 5% VM and waste products, which are not suitable ordinarily for direct injection, and imparts lubricity to the lime flow which eliminates the need for separately added flow aids, e.g., silicones.

Anthracite coal, and to a lesser extent fluid green petroleum coke, provide the unique advantages of attaining more consistent quantities of VM (a measure of gas generating ability) as compared to and lower than the hydrogen released from polypropylene, and of providing the ability to mix lime into the molten iron at rates substantially equal to those attained through the use of lime-magnesium.

The desulfurizing process of the present invention is conducted in much the same manner as the lime-magnesium process described in U.S. Pat. No. 3,998,625 and the lime-polypropylene process in patent application Ser. No. 114,262 but provides a substantial cost savings as compared to those other lime processes. The process of the present invention, although not as highly reactive as the lime-polypropylene process, provides a safer one and one with a broader range of control.

In conducting the process with in-line mixing of the lime and the hydrocarbon particulates, lime injection the following TABLE I, which sets forth the average parameters (in a horizontal line) for a series of runs for each one of the materials listed (in the first column), was developed. The equivalent magnesium usage data was calculated from a chart developed in work which was previously conducted in conjunction with the lime-magnesium process.

From the TABLE I it will be observed that the use of green petroleum coke provides an average blow time less than the use of magnesium does and that the use of anthracite coal requires an average blow time substantially equal to or slightly greater than the use of magnesium does. However, it should be noted that any increase in time is more than offset by the cost savings reactant agent. At the time the runs were made (from which the TABLE I was developed) the average price of magnesium was $1.50/lb; the price of polypropylene was about $0.50/lb; anthracite coal was available at $0.055/lb; and green petroleum coke was available at $0.11/lb.

TABLE I

| Hydrocarbon Source Material | VM % | % Sulfur Start | % Sulfur Finish | Actual Used Lime Lbs. | Actual Used Material Lbs. | Actual Used Time Min. | Equivalent Use Lime Lbs. | Equivalent Use Mg. Lbs. | Equivalent Use Time Min. | Average Rate Use Lime Lb/min. | Average Rate Use Material Lb/min. | Average Rate Use Mg. Lb/min. |
|---|---|---|---|---|---|---|---|---|---|---|---|---|
| 1. Green Petroleum Coke | 5.8 | .066 | .020 | 2826 | 238 | 16 | 3100 | 196 | 19 | 177 | 14.9 | 10.3 |
| 2. Anthracite Coal 30 × 150 mesh | 8.9 | .042 | .018 | 1978 | 130 | 13 | 1550 | 117 | 12.1 | 160 | 10.1 | 10 |
| 3. Anthracite Coal 8 × 50 mesh | 8.9 | .051 | .019 | 2361 | 150 | 17 | 2153 | 147 | 16 | 139 | 8.8 | 9.2 |
| 4. Anthracite Coal 30 × 150 mesh | 8.1 | .050 | .09 | 2347 | 197 | 17 | 2032 | 157 | 15 | 138 | 11.6 | 10.5 |
| 5. Anthracite Coal 30 × 150 mesh | 8.1 | .052 | .022 | 2447 | 185 | 17 | 2100 | 155 | 14 | 144 | 10.9 | 11.1 |

In other words, polypropylene is about 33%, green petroleum coke is about 7.3%, and coal about 3.6% the cost per lb. of the magnesium. Although more reactant in the form of coke or coal may be required the total cost is less than that of the magnesium required.

In test runs which were subsequently run with coal, it was discovered that better desulfurizing performance was obtained if the coal was injected at a comparatively rapid rate of about 14 to 18 lb/min., at the start of the injection or blow cycle and at a slower rate, after 60–70% of the total time of the cycle had expired, of about 8 to 12 lb/min.

In another series of test runs with the use of a premixture of lime and a hydrocarbon source, green petroleum coke or coal fines, the data in the following TABLE II was developed. The values shown are the average ones for the series. These runs were made prior to those made in developing TABLE I and initially made in an attempt to develop a process in which the use of magnesium could be reduced, rather than totally eliminated.

In the runs represented by TABLE II the carbon content of the carbon source was judged to be in excess of 9% and the loss on ignition factor LOI to be greater than 11%. With a premixture of lime and carbon source, since it is not feasible to measure (if not impossible) the volatile matter VM contained in the carbon source, the gas release level or potential is better represented by the LOI, which represents the VM and any moisture contained by the lime.

TABLE II

| Actual Used | | | | | | | | |
|---|---|---|---|---|---|---|---|---|
| Sulfur | | | Lime + Carbon | | | Calculated for Lime & Mg Only | | |
| Start % | Final % | Time Min. | Source Lbs. | Mg Lbs. | NTHM | Time Min. | Lime Lbs. | Mg Lbs. |
| .035 | .016 | 11 | 1616 | 23 | 162 | 12 | 1133 | 73 |

*NTHM = Net Tons Hot Metal

It will be readily observed from TABLE II that with the use of the hydrocarbon source the use of the magnesium and the lime were both substantially reduced.

Two other series of runs were made, one with the carbon content of the premixture being in the range of 3 to 6% wt. and the LOI in the range of 4 to 6% wt. and the other series with the carbon content being in the range of 8 to 9% wt. and the LOI in the range of 10.0 to 10.5% wt.; however, the results of these runs were not as favorable as those shown in TABLE II.

It will be apparent that the present invention provides a process for desulfurizing a bath of molten iron in a vessel including the step of injecting particulate lime and a carbon-containing particulate compound containing at least carbon and hydrogen in porportions ranging from $CH_{>0}$ to $CH_2$, wherein the carbon-containing particulate compound is of a type having a volatile matter concentration (VM) of 5 to 20%, by weight, e.g., green petroleum coke, anthracite coal fines, or wherein the carbon-containing particulate compound is mixed with the lime to form a premixture, which preferably has a loss on ignition factor (LOI) of at least 11%; the VM and LOI being measures of the gas generating ability of the compound or premixture to provide stirring in the bath, which stirring is less violent and easier to control than that provided through the use of polyproplene.

What is claimed is:

1. In a process for desulfurizing a bath of molten iron contained in a vessel which comprises the step of injecting particulate lime and a carbon-containing particulate compound containing at least carbon and hydrogen in proportions ranging from $CH_{>0}$ to $CH_2$ the improvement wherein:

said carbon-containing particulate compound is of a type which has a volatile matter concentration of 5 to 20%, by weight.

2. The improvement described in claim 1, wherein: said carbon-containing particulate compound is green petroleum coke.

3. The improvement described in claim 1, wherein: said carbon-containing particulate compound is anthracite coal.

4. The improvement described in claim 3, wherein: said anthracite coal is injected at a rate of about 14 to 18 lb/min during the first 60 to 70% of the time required for the entire injection cycle and at a rate of 8 to 12 lb/min during the remainder of the injection cycle.

5. The improvement described in claim 3, wherein: said anthracite coal is of a mesh of 30×150, or fines.

6. The improvement described in claim 1, wherein: said carbon-containing particulate compound has a hydrogen content of less than 14%, by weight.

7. The improvement described in claim 1, wherein: said particulate lime and said particulate carbon-containing compound are mixed in-line during the injection.

8. The improvement described in claim 1, wherein: said carbon-containing compound has a volatile matter concentration of 8.5 to 11%, by weight.

9. In a process for desulfurizing a bath of molten iron contained in a vessel which comprises the step of injecting particulate lime and a carbon-containing particulate compound containing at least carbon and hydrogen in proportions ranging from $CH_{>0}$ to $CH_2$ the improvement wherein:

said lime and said compound are formed as a premixture contained in a dispensing vessel and said premixture has a loss on ignition factor greater than 11%, by weight.

10. The improvement described in claim 9, wherein: magnesium is injected together with said premixture.

* * * * *